US005606357A

United States Patent [19]

Bekki

[11] Patent Number: 5,606,357

[45] Date of Patent: Feb. 25, 1997

[54] SHEET CONVEYING MEANS AND AN INK JET RECORDING APPARATUS HAVING THE SAME

[75] Inventor: Toshihiko Bekki, Kawasaki, Japan

[73] Assignee: Canon Kabushiki Kaisha, Tokyo, Japan

[21] Appl. No.: 478,826

[22] Filed: Jun. 7, 1995

Related U.S. Application Data

[63] Continuation of Ser. No. 251,668, May 31, 1994, abandoned, which is a continuation of Ser. No. 731,872, Jul. 18, 1991, abandoned.

[30] Foreign Application Priority Data

Jul. 20, 1990 [JP] Japan ..... 2-192673

[51] Int. Cl.[6] ..... B41J 2/01

[52] U.S. Cl. ..... 347/104; 271/274; 464/179

[58] Field of Search ..... 347/104; 271/272, 271/274, 314; 400/636; 464/179, 180, 183, 185

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/140 R X |
| 4,478,402 | 10/1984 | Kane | 271/274 X |
| 4,486,258 | 12/1984 | Schrotz et al. | 156/384 |
| 4,558,333 | 12/1985 | Sugitani et al. | 346/140 R |
| 4,723,129 | 2/1988 | Endo et al. | 346/140 R X |
| 4,740,796 | 4/1988 | Endo et al. | 346/140 R |
| 4,767,114 | 8/1988 | Nishimoto | 271/3 |
| 4,997,179 | 3/1991 | Mizutani et al. | 271/274 X |
| 5,163,674 | 11/1992 | Parks | 271/274 |
| 5,170,183 | 12/1992 | Hirabayashi et al. | 346/134 |
| 5,170,184 | 12/1992 | Hanabusa et al. | 346/134 |
| 5,187,497 | 2/1993 | Hirano et al. | 346/140 R |

FOREIGN PATENT DOCUMENTS

| | | |
|---|---|---|
| 239317 | 9/1987 | European Pat. Off. . |
| 7712267 | 4/1977 | Germany . |
| 58-008679 | 1/1983 | Japan . |
| 59-123670 | 7/1984 | Japan . |
| 59-138461 | 8/1984 | Japan . |
| 60-143987 | 7/1985 | Japan . |
| 61-206676 | 9/1986 | Japan . |
| 1-267076 | 10/1989 | Japan . |
| 2-41277 | 2/1990 | Japan . |
| 2-158555 | 6/1990 | Japan . |
| 8101134 | 4/1981 | WIPO . |

*Primary Examiner*—Nestor R. Ramirez

*Attorney, Agent, or Firm*—Fitzpatrick, Cella, Harper & Scinto

[57] ABSTRACT

A sheet conveying device for conveying a sheet includes a rotatable member, a spur provide in opposed relationship with the rotatable member, and a resilient member supporting the spur and provided in a curved state so as to press the spur against the rotatable member. The resilient member is in the form of a closely wound tension coil spring.

94 Claims, 5 Drawing Sheets

SHEET CONVEYING MEANS AND AN INK JET RECORDING APPARATUS HAVING THE SAME

This application is continuation of application Ser. No. 08/251,668 filed May 31, 1994, now abandoned, which is a continuation of application Ser. No. 07/731,872 filed Jul. 18, 1991, now abandoned.

BACKGROUND OF THE INVENTION

1. Field of the Invention

This invention relates to sheet conveying means and an ink jet recording apparatus having the same.

2. Related Background Art

Sheet conveying means for conveying a sheet conveys the sheet with a spur brought into contact with the sheet with a pressure force. In order to make the sheet conveying means compact, there is one in which the shaft of the spur is provided by a resilient member to thereby obtain the pressure force against the sheet. In such construction, however, it has been difficult to obtain a stable pressure force irrespective of the thickness of a sheet being conveyed.

SUMMARY OF THE INVENTION

It is an object of the present invention to provide sheet conveying means in which a stable pressure force is obtained irrespective of the thickness of a sheet being conveyed.

Now, the following problems have been encountered when the above-described conventional sheet conveying means provided with a spur is applied to the field of an ink jet recording apparatus.

Where an ink droplet is large, or where it is difficult for a sheet itself such as an OHP sheet to absorb ink, or where the ink fixativeness of plain paper or the like is not good, if the pressure force of the spur against the sheet is too great, ink will adhere to the spur and the ink will again adhere to the sheet to stain the sheet.

Further, if the pressure force of the spur against the uneven portion of a sheet which is created by being wet with ink is too great, stable conveyance of the sheet will not be realized.

So, it is another object of the present invention to provide an ink jet recording apparatus provided with sheet conveying means which can realize stable conveyance of a sheet by an appropriate pressure force against the presence of the unfixed or unfixated portion of an ink droplet and the presence of the uneven portion of the sheet wet with ink.

It is another object of the present invention to provide sheet conveying means for conveying a sheet characterized by a rotatable member, a spur provided in opposed relationship with said rotatable member, and a resilient member supporting said spur and provided in a curved state so as to press said spur against said rotatable member.

It is another object of the present invention to provide a recording apparatus for effecting recording on a sheet characterized by sheet conveying means having a rotatable member, a spur provided in opposed relationship with said rotatable member, and a resilient member supporting said spur and provided in a curved state so as to press said spur against said rotatable member, and recording means for effecting recording on the sheet.

It is another object of the present invention to provide an ink jet recording apparatus characterized by a recording head having a discharge port for discharging ink therethrough to thereby effect recording on a recording medium, conveying means for conveying said recording medium having a conveying roller, a spur provided in opposed relationship with said conveying roller, and a resilient member supporting said spur and provided in a curved state so as to press said spur against said conveying roller, and a carriage capable of moving said recording head in a predetermined direction.

DESCRIPTION OF THE PREFERRED EMBODIMENTS

Figure 2:
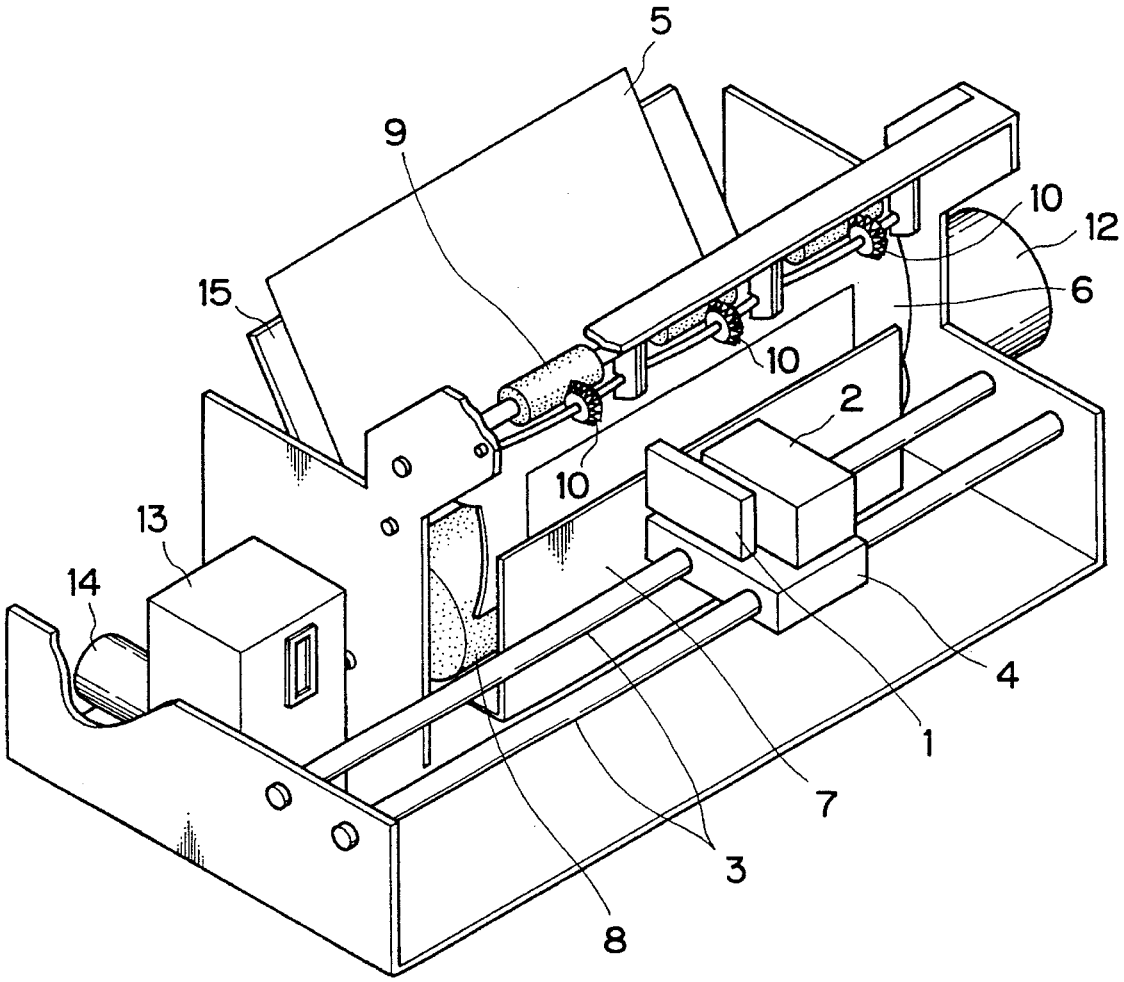
FIG. 2 is a schematic perspective view showing an ink jet recording apparatus to which an embodiment of the present invention is applied.

An ink jet recording apparatus to which sheet conveying means according to the present invention can be suitably applied will hereinafter be described with respect to an embodiment thereof shown. FIG. 2 schematically shows the construction of an ink jet printer to which the present invention is applied. In FIG. 2, a recording head 1 discharges ink by a recording signal, and is supplied with ink by an ink tank 2. A carriage 4 carrying thereon the recording head 1 and the ink head 2 is guided by guide shafts 3, and is reciprocally moved along the guide shafts 3 by a belt transmission mechanism and a driving motor, not shown. A recording sheet 5 is held from the back thereof by a platen 6 lying at a location opposed to the recording head 1. The recording sheet 5 is brought into intimate contact with the platen 6 by a paper keep plate 7. The recording sheet 5 thus brought into intimate contact with the platen is fed by a paper feeding roller 8. The recording paper 5 on which recording has been effected is discharged by a discharge roller 9. Spurs 10 are provided in opposed relationship with the discharge roller 9 and urge the recording sheet 5 against the discharge roller. The spurs 10 are biased toward the recording sheet 5 by an urging force by the flexure of a shaft which will be described later. The roller 8 and the roller 9 are driven by a paper feeding motor 12. A recovery system device 13 performs the recovery operation for preventing the clogging or the like of the discharge port of the recording head 1, and further performs the capping operation for preventing the desiccation of the discharge port when recording is not effected. This recovery system device 13 is driven by a recovery system driving motor 14.

The recording sheet 5 is inserted along a paper pan 15.

The operation of the above-described ink jet printer will now be described. The recording sheet 5 inserted along the paper pan 15 is fed to the platen 6 with the inserted leading end thereof turned into a U-shape by the roller 8 and is brought into intimate contract with the platen 6 by the keep plate 7. Ink is jetted from the recording head 1 by a recording signal and adheres to the recording sheet 5. By this adherence, characters or images are formed. As this recording operation progresses, the portions of the recording sheet 5 on which recording has been effected are successively fed upwardly by the roller 8. When the leading end portion of the recording sheet 5 arrives at the spurs 10, the recording sheet 5 is pushed from its recording surface by the spurs 10 and the back of the recording sheet is urged against the roller 9, and the recording sheet is further conveyed upwardly by the rotation of the roller 9 and is discharged outwardly.

Figure 1A:
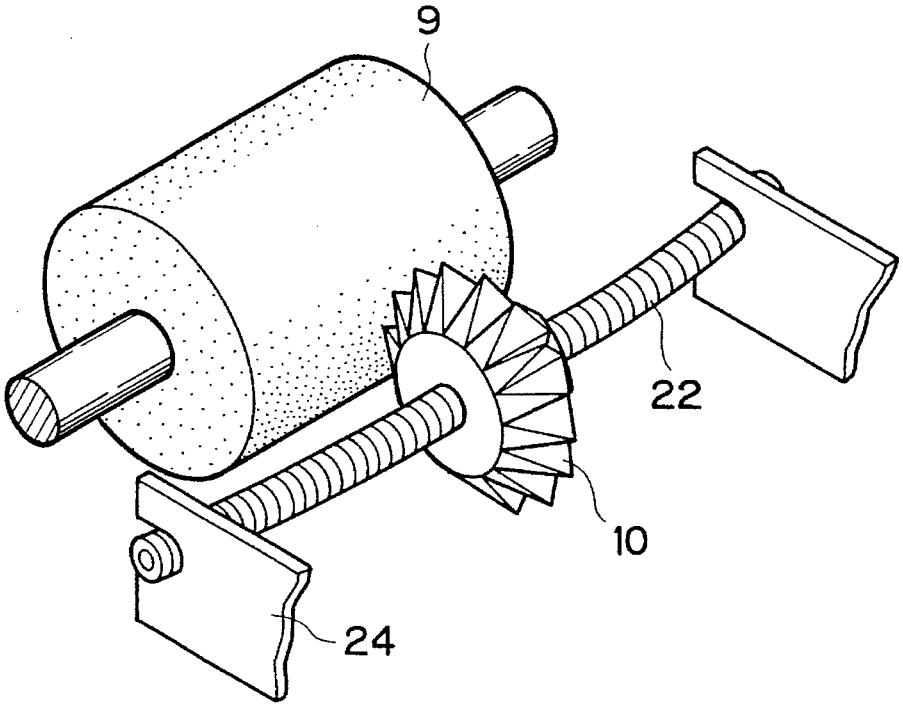
FIG. 1A is a perspective view showing a first embodiment of the present invention.

Now, each spur 10 having pointed tip ends is constructed as shown in FIGS. 1A and lB.

Figure 1B:
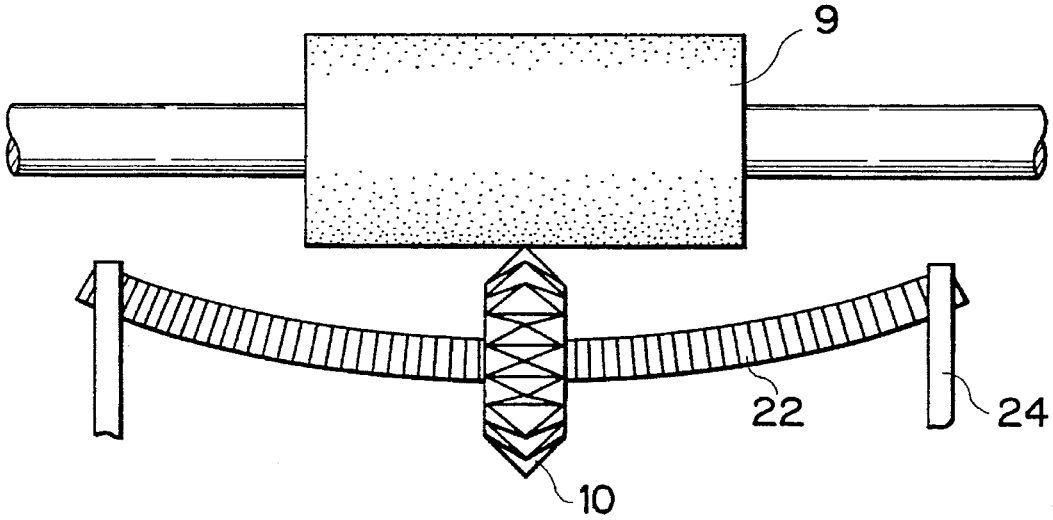
FIG. 1B is a front view showing the first embodiment of the present invention.

In FIGS. 1A and 1B, the reference numeral 10 designates the spur, the reference numeral 22 denotes the shaft of the spur which comprises a closely wound tension coil spring, the reference numeral 9 designates the discharge roller formed of rubber or the like, and the reference numeral 24 denotes spur holders for supporting the spur 10 and the shaft 22 of the spur. In order that an appropriate pressure force necessary to convey the recording sheet 5 may be applied to the recording sheet 5 on which recording has been effected and which passes between the spur 10 and the discharge roller 9, the positions of the discharge roller 9, the spur 10 and the spur holders 24 are set so that the shaft 22 of the spur may somewhat flex as shown in FIG. 1B. An example of the graph of the displacement and load of the closely wound tension coil spring used in the present embodiment is shown in FIG. 3.

Figure 3:
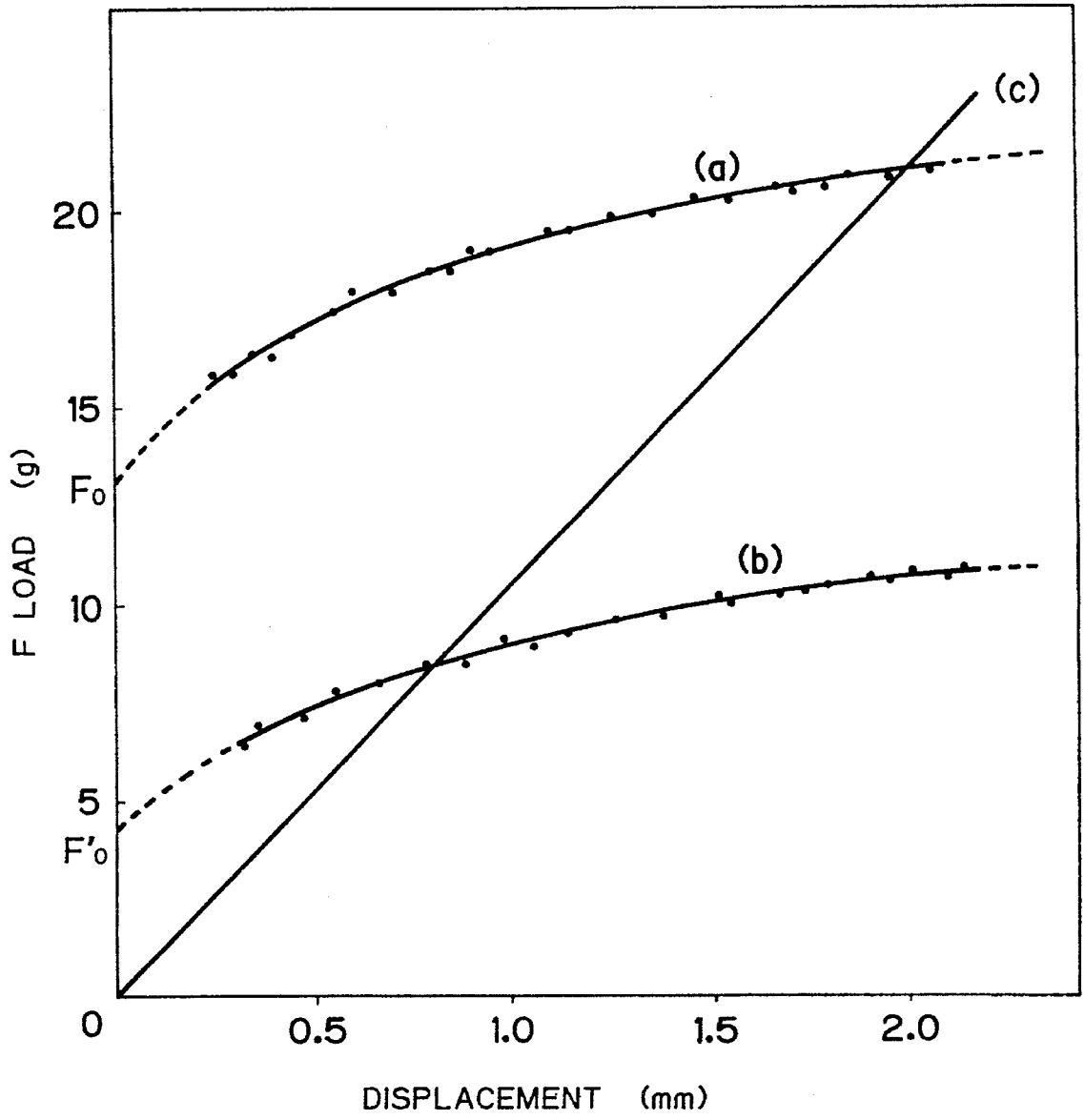
FIG. 3 is a graph showing the relation between the displacement and load of a spring in an embodiment of the present invention.
Figure 4:
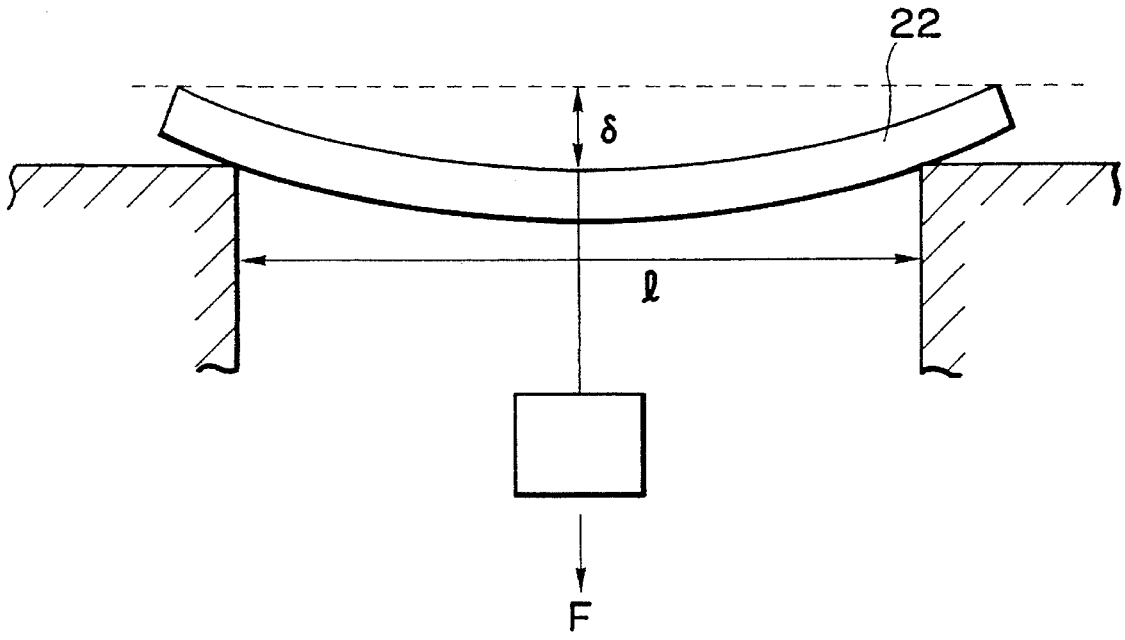
FIG. 4 illustrates a method of applying the load of FIG. 3.

The graph of FIG. 3 shows the relation between the flexure δ of the center of the closely wound tension coil spring when, as shown in FIG. 4, a load is made to act vertically downwardly on the center of the spring supported at its opposite ends by a span l and said load.

When the experiment as shown in FIG. 4 is carried out by the use of a tension spring as a heretofore used resilient member instead of the closely wound tension coil spring, the following fact is found.

When the vertical elastic modulus of said tension spring is E and the cross-sectional secondary moment thereof is I and the span thereof is l and the flexure of the center of the span is δ and the load acting on the center of the span is F, the following equation is established:

$$\delta = \frac{Fl^3}{48EI} \tag{1}$$

This equation (1) is the linear function of δ and F within the limit of elasticity of the spring. When this tension spring is used as the shaft of the spur of the sheet conveying means, this shaft flexes correspondingly to the thickness of the sheet being conveyed, and there is created the pressure force from the spur to the sheet which is found from equation (1). Thus, the pressure force varies greatly correspondingly to the thickness of the sheet being conveyed (as shown by (c) in FIG. 3). However, when the closely wound tension coil spring according to the present invention is used as the shaft of the spur, it will be seen that a pressure force corresponding to the initial tension $F_0$ can be created even if flexure, i.e., the displacement δ of the shaft, is almost 0, while on the other hand, a pressure force slightly greater than the initial tension $F_0$ is created even when the shaft is flexed by the sheet being conveyed.

The relationship of the closely wound tension coil spring shown in (a) of FIG. 3 which is used in the sheet conveying means according to the present invention is such that the pressure force created within the range of 0.5 mm to 2.0 mm of the displacement amount is about 17 g to about 21 g. Further, by varying the torsion applied to the coil when the coil is wound into a closely wound form, the initial tension $F_0$ can be changed to $F_0'$. The relationship of the closely wound tension coil spring shown in (b) of FIG. 3 is such that the pressure force created within the range of 0.5 mm to 2.0 mm of the displacement amount can be changed from about 7 g to about 10 g.

Figure 5A:
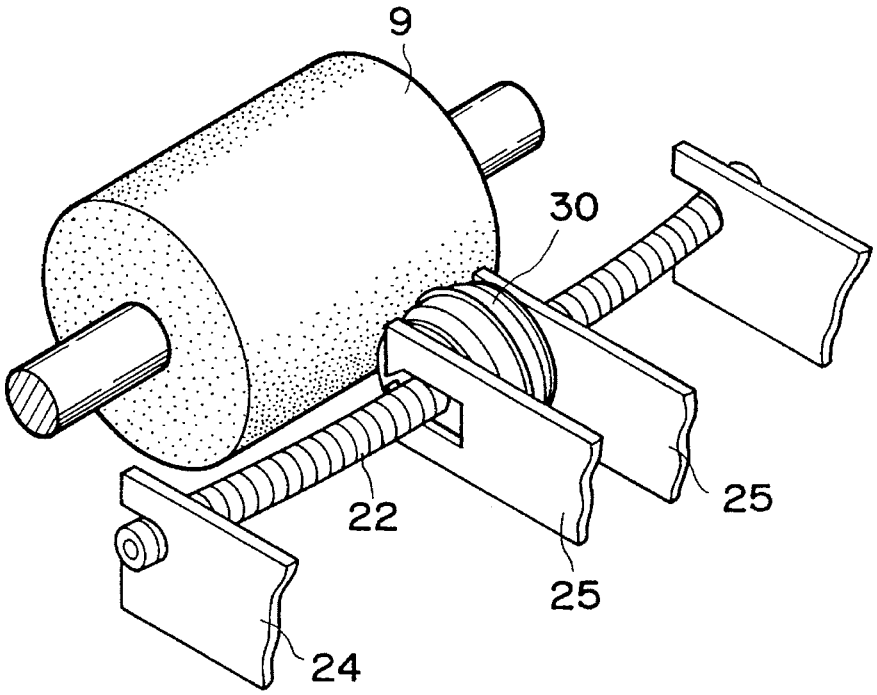
FIGS. 5A and 5B show another embodiment of the present invention.
Figure 5B:
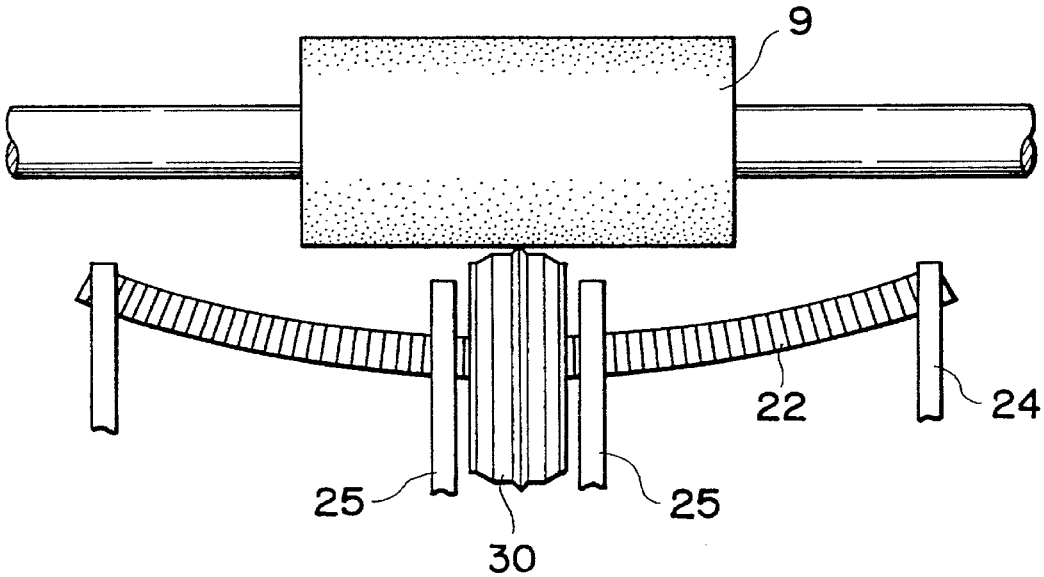

FIGS. 5A and 5B show another embodiment of the present invention. The closely wound tension coil spring used in this embodiment is that shown in (b) of FIG. 3, and the spring constant thereof is 44 g/mm, the diameter of the wire thereof is 0.2 mm±0.01 mm, the outer diameter of the coil thereof is ϕ9±0.05 mm, the length thereof is 18.4±0.2 mm, the effective number of turns thereof is 92, the span thereof is 16 mm, and the load F when the spring is displaced by δ=1 mm at the center of the span is 9±1 g. The material of the spring is a so-called spring material such as SUS or piano wire.

Also, the spur used is of a pillar-like shape having a diameter of 6 mm and a thickness of 2.2 mm and having pointed projections provided on the center of the direction of thickness over the side of the pillar. The material of the spur may be, for example, a metal if it is a water repellent material, but may suitably be fluorine resin, polyacetal or the like.

The spur 30 is threaded through a shaft made of a closely wound tension coil spring, and is resilently mounted on the apparatus by means of members 25 and 25. At this time, the spur is provided so as to protrude toward the sheet conveying surface by 1 mm. That is, the spring is provided in a curved state on the apparatus while supporting the spur. The spur is restricted in its horizontal movement by the members 25 and 25.

When paper (having a thickness of 0.1 mm–0.2 mm) or an envelope (having a thickness of about 0.5 mm) is to be conveyed as a sheet, the displacement amount of the spring is 1.1 mm to 1.5 mm and the pressure force can keep a substantially constant value of about 9.5 g–10.5 g. Therefore, where this spur is used in an ink jet recording apparatus, the pressure force obtained is substantially constant even if the thickness of the paper material varies, and stable conveyance of the paper material is possible.

Further, if the wire material of the closely wound tension coil spring is thickened and the initial tension is increased to 50 g–100 g, there can be provided sheet conveying means which will require a great pressure force for the conveyance of a paper material such as continuous paper.

The spring constant of the closely wound tension coil spring which can be suitably used in the present embodiment is greater than 10 g/mm and less than 100 g/mm, and preferably greater than 30 g/mm and less than 50 g/mm, and most preferably greater than 40 g/mm and less than 45 g/mm.

The outer diameter of the coil is greater than 0.5 mm and less than 2 mm, and preferably greater than 0.8 mm and less than 1.0 mm.

The thickness of the wire material used, with about ⅕ of the outer diameter of the coil as the standard, is greater than 0.1 mm and less than 0.4 mm, and preferably greater than 0.15 mm and less than 0.2 mm.

The span is determined by the wire diameter of the spring material used, the displacement amount and the pressure force obtained, and is preferably greater than 5 mm and less than 30 mm, and more preferably greater than 10 mm and less than 20 mm.

Also, the flexure amount (the displacement amount) δ is greater than 1 mm and less than 2 mm, and preferably greater than 1 mm and less than 1.5 mm if the sheet material is plain paper, and preferably greater than 1 mm and less than 1.2 mm if the sheet material is continuous paper.

The present invention brings about an excellent effect particularly in a recording head and a recording apparatus of the ink jet type which utilize heat energy to form flying droplets and accomplish recording, among the ink jet recording systems.

The typical construction and principle of such system may preferably be based on the basic principle disclosed, for example, in U.S. Pat. No. 4,723,129 or U.S. Pat. No. 4,740,796. This system is applicable to both of the so-called on-demand type and the so-called continuous type, and particularly in the case of the on-demand type, it is effective because at least one driving signal corresponding to recording information and providing a rapid temperature rise exceeding nucleate boiling is applied to an electro-thermal conversion member disposed correspondingly to a sheet or a liquid path in which liquid (ink) is retained, whereby heat energy is generated in the electro-thermal conversion member to thereby cause film boiling on the heat-acting surface of a recording head with a result that a bubble in the liquid (ink) corresponding at one to one to said driving signal can be formed. By the growth and contraction of this bubble, the liquid (ink) is discharged through a discharge opening to thereby form at least one droplet. If this driving signal is made into a pulse-like shape, the growth and contraction of the bubble will take place appropriately on the spot and therefore, the discharge of the liquid (ink) particularly excellent in responsiveness can be achieved, and this is more preferable.

The signal as described in U.S. Pat. No. 4,463,359 or U.S. Pat. No. 4,345,262 is suitable as said pulse-shaped driving signal. The adoption of the conditions described in U.S. Pat. No. 4,313,124 which discloses an invention relating to the temperature rise rate of said heat-acting surface would lead to the possibility of accomplishing more excellent recording.

As regards the construction of the recording head, besides the combination (straight liquid flow paths or right-angled liquid flow paths) of discharge ports, liquid paths and electro-thermal conversion members as disclosed in the above-mentioned patents, a construction using U.S. Pat. No. 4,558,333 or U.S. Pat. No. 4,459,600 which discloses a construction in which the heat-acting portion is disposed in a crooked area is also covered by the present invention.

In addition, a construction based on Japanese Laid-Open Patent Application No. 59-123670 which discloses a construction in which a slit common to a plurality of electro-thermal conversion members provides the discharge portion of the electro-thermal conversion members or Japanese Laid-Open Patent Application No. 59-138461 which discloses a construction in which an opening for absorbing the pressure wave of heat energy corresponds to a discharge portion is also effective for the present invention.

Further, the full line type recording head having a length corresponding to the width of the largest recording medium on which recording can be effected by a recording apparatus may be either of the construction as disclosed in the above-mentioned publications wherein the length of the head is satisfied by a combination of a plurality of recording heads and a construction as a unitarily formed single recording head, and the present invention can display the above-described effect more effectively.

In addition, the present invention is effective when use is made of an interchangeable chip type recording head which can be electrically connected to the apparatus body or can be supplied with ink from the apparatus body by being mounted on the apparatus body, or a cartridge type recording head having an ink tank integrally provided in itself.

Also, the addition of recovery means, preliminary auxiliary means, etc. to the recording head in the construction of the recording apparatus of the present invention is preferable in that it can more stabilize the effect of the present invention. More specifically, these include capping means for the recording head, cleaning means, pressing or suction means, an electro-thermal conversion member or a heating element or preheating means comprising a combination of these, and carrying out the preliminary discharge mode in which discharge discrete from that during recording is effected is also effective to accomplish stable recording.

Further, the recording mode of the recording apparatus is not limited to the recording mode for the main color such as black, but the recording head may be unitarily constructed or provided by a combination of a plurality of heads, and the present invention is also very effective for an apparatus provided with different colors or at least one of full colors by mixed colors.

In the above-described embodiment of the present invention, the ink has been described as liquid, but the ink may be ink which solidifies at room temperature or below and softens or is liquid at room temperature, or ink which assumes its liquid phase when the recording signal used is imparted, because it is usual with the above-described ink jet system that ink itself is temperature-controlled within the range of 30° C. to 70° C. so that the viscosity of the ink may be within a stable discharge range.

Furthermore, the recording apparatus according to the present invention may adopt the form of an apparatus provided integrally with or discretely from an information processing instrument such as a word processor or a computer as the image output end thereof, or a copying apparatus combined with a reader, or a facsimile apparatus having the signal transmitting and receiving functions.

As described above, according to the present invention, there is provided sheet conveying means which creates a stable pressure force irrespective of the thickness of a sheet material being conveyed.

Further, according to the present invention, there is provided an ink jet recording apparatus provided with sheet conveying means which can realize stable sheet conveyance by an appropriate pressure force against the presence of a portion to which an ink droplet does not yet adhere and the presence of the uneveness of the sheet material wet with ink.

What is claimed is:

1. Sheet conveying means for conveying a sheet, said sheet conveying means comprising:

a spur for guiding the sheet, said spur being provided opposed to a rotatable member for conveying the sheet; and a closely wound tension coil spring arcuately provided to support said spur and press said spur to the rotatable member, said closely wound tension coil spring having a first portion, one end of which is movably supported, a second portion, one end of which is movably supported, and an intermediate portion provided between said first and second portions, said first, second and intermediate portions being continuously formed, wherein the closely wound tension coil spring is capable of changing an initial tension by varying a twisting degree applied when a coil is closely wound.

2. Sheet conveying means according to claim 1, wherein the rotatable member comprises a roller for conveying the sheet.

3. Sheet convey means according to claim 1, wherein the closely wound tension coil spring is capable of changing the initial tension by varying the twisting degree applied when the coil is closely wound and changing the relation between a bending amount at a center span of the spring and a load of the spring in a bending direction.

4. Sheet convey means according to claim 1, wherein the closely wound tension coil spring is capable of changing the initial tension by varying the twisting degree when the coil is closely wound and changing a load range in a bending direction when a bending amount at a center span of the spring is at least 0.5 mm and no more than 2.0 mm from at least 17 g and no more than 21 g to at least 7 g and no more than 10 g.

5. Sheet convey means according to claim 1, wherein when a load of the closely wound tension coil spring is at least 8 g and no more than 10 g when a spring constant is 44 g/mm, an outer diameter of the coil spring is at least 8.95 mm and no more than 9.05 mm, a diameter of a wire forming the coil spring is at least 0.19 mm and no more than 0.21 mm, a length of the coil spring is at least 18.2 mm and no more than 18.6 mm, an effective number of turns of the coil spring are 92, and a span length of the coil spring is 16 mm, then a bending amount of a center span is 1 mm.

6. Sheet convey means according to claim 1, wherein the closely wound tension coil spring has a spring constant of at least 10 g/mm and no more than 100 g/mm.

7. Sheet convey means according to claim 1, wherein the closely wound tension coil spring has an outer diameter of at least 0.5 mm and no more than 2 mm.

8. Sheet convey means according to claim 1, wherein a diameter of a wire forming the closely wound tension coil spring is equal to one-fifth of the outer diameter of the coil spring.

9. Sheet convey means according to claim 1, wherein the closely wound tension coil spring has a span length of the coil spring of at least 5 mm and no more than 30 mm.

10. Sheet convey means according to claim 1, wherein the closely wound tension coil spring has a span bending amount of at least 1 mm and no more than 2 mm.

11. An apparatus for effecting recording on a sheet, said apparatus comprising:

sheet conveying means for conveying the sheet, said conveying means including a spur for guiding the sheet, said spur being provided opposed to a rotatable member for conveying the sheet, and a closely wound tension coil spring arcuately provided to support said spur and press said spur to the rotatable member, said closely wound tension coil spring having a first portion, one end of which is movably supported, a second portion, one end of which is movably supported, and an intermediate portion provided between said first and second portions, said first, second and intermediate portions being continuously formed; and a conveyance system for defining a conveyance route for conveying the sheet to said sheet conveying means, wherein the closely wound tension coil spring is capable of changing an initial tension by varying a twisting degree applied when a coil is closely wound.

12. A recording apparatus according to claim 11, wherein the rotatable member is a roller for conveying the sheet.

13. A recording apparatus according to claim 11, wherein said apparatus comprises a printer.

14. A recording apparatus according to claim 11, further comprising recording means for recording on the sheet, wherein said recording means comprises a recording head provided with an electro-thermal conversion member for generating heat energy in conformity with a recording signal, and which utilizes the heat energy to discharge ink.

15. A recording apparatus according to claim 11, further comprising recording means for recording on the sheet, wherein said recording means comprises an electro-thermal conversion member for generating heat energy which causes film boiling in ink.

16. An apparatus according to claim 11, wherein the closely wound tension coil spring is capable of changing the initial tension by varying the twisting degree applied when the coil is closely wound and changing the relation between a bending amount at a center span of the spring and a load of the spring in a bending direction.

17. An apparatus according to claim 11, wherein the closely wound tension coil spring is capable of changing the initial tension by varying the twisting degree when the coil is closely wound and changing a load range in a bending direction when a bending amount at a center span of the spring is at least 0.5 mm and no more than 2.0 mm from at least 17 g and no more than 21 g to at least 7 g and no more than 10 g.

18. An apparatus according to claim 11, wherein when a load of the closely wound tension coil spring is at least 8 g and no more than 10 g when a spring constant is 44 g/mm, an outer diameter of the coil spring is at least 8.95 mm and no more than 9.05 mm, a diameter of a wire forming the coil spring is at least 0.19 mm and no more than 0.21 mm, a length of the coil spring is at least 18.2 mm and no more than 18.6 mm, an effective number of turns of the coil spring are 92, and a span length of the coil spring is 16 mm, then a bending amount of a center span is 1 mm.

19. An apparatus according to claim 11, wherein the closely wound tension coil spring has a spring constant of at least 10 g/mm and no more than 100 g/mm.

20. An apparatus according to claim 11, wherein the closely wound tension coil spring has an outer diameter of at least 0.5 mm and no more than 2 mm.

21. An apparatus according to claim 11, wherein a diameter of a wire forming the closely wound tension coil spring is equal to one-fifth of the outer diameter of the coil spring.

22. An apparatus according to claim 11, wherein the closely wound tension coil spring has a span length of the coil spring of at least 5 mm and no more than 30 mm.

23. An apparatus according to claim 11, wherein the closely wound tension coil spring has a span bending amount of at least 1 mm and no more than 2 mm.

24. An ink jet recording apparatus comprising:

conveying means for conveying a recording medium, said conveying means comprising a spur for guiding the recording medium, said spur being provided opposed to a conveying roller for conveying the recording medium, and a closely wound tension coil spring arcuately provided to support said spur and press said spur to the conveying roller, said closely wound tension coil spring having a first portion, one end of which is movably supported, a second portion, one end of which is movably supported, and an intermediate portion provided between said first and second portions, said first, second and intermediate portions being continuously formed; and a support member for supporting an ink jet recording head having a discharge port for discharging ink onto the recording medium, wherein the closely wound tension coil spring is capable of changing an initial tension by varying a twisting degree applied when a coil is closely wound.

25. An ink jet recording apparatus according to claim 24, wherein said recording head comprises an electro-thermal conversion member, and cause ink to be discharged from said discharge port by the growth of a bubble by film boiling caused by heat energy generated by said electro-thermal conversion member.

26. An apparatus according to claim 24, wherein the closely wound tension coil spring is capable of changing the initial tension by varying the twisting degree applied when the coil is closely wound and changing the relation between a bending amount at a center span of the spring and a load of the spring in a bending direction.

27. An apparatus according to claim 24, wherein the closely wound tension coil spring is capable of changing the initial tension by varying the twisting degree when the coil is closely wound and changing a load range in a bending direction when a bending amount at a center span of the spring is at least 0.5 mm and no more than 2.0 mm from at least 17 g and no more than 21 g to at least 7 g and no more than 10 g.

28. An apparatus according to claim 24, wherein when a load of the closely wound tension coil spring is at least 8 g and no more than 10 g when a spring constant is 44 g/mm, an outer diameter of the coil spring is at least 8.95 mm and no more than 9.05 mm, a diameter of a wire forming the coil spring is at least 0.19 mm and no more than 0.21 mm, a length of the coil spring is at least 18.2 mm and no more than 18.6 mm, an effective number of turns of the coil spring are 92, and a span length of the coil spring is 16 mm, then a bending amount of a center span is 1 mm.

29. An apparatus according to claim 24, wherein the closely wound tension coil spring has a spring constant of at least 10 g/mm and no more than 100 g/mm.

30. An apparatus according to claim 24, wherein the closely wound tension coil spring has an outer diameter of at least 0.5 mm and no more than 2 mm.

31. An apparatus according to claim 24, wherein a diameter of a wire forming the closely wound tension coil spring is equal to one-fifth of the outer diameter of the coil spring.

32. An apparatus according to claim 24, wherein the closely wound tension coil spring has a span length of the coil spring of at least 5 mm and no more than 30 mm.

33. An apparatus according to claim 24, wherein the closely wound tension coil spring has a span bending amount of at least 1 mm and no more than 2 mm.

34. Sheet conveying means for conveying a sheet, said sheet conveying means comprising:

a first rotatable member for guiding the sheet, said first rotatable member being provided opposed to a second rotatable member for conveying the sheet; and a closely wound coil spring for supporting said first rotatable member and bending to press said first rotatable member to the second rotatable member when guiding the sheet, said closely wound coil spring having a first portion, one side end of which is movably supported, a second portion, another side end of which is movably supported, and an intermediate portion provided between said first and second portions, said first, second and intermediate portions being continuously formed, wherein the closely wound coil spring is capable of changing an initial tension by varying a twisting degree applied when a coil is closely wound.

35. Sheet conveying means according to claim 34, wherein the closely wound coil spring is capable of changing the initial tension by varying the twisting degree applied when the coil is closely wound and changing the relation between a bending amount at a center span of the spring and a load of the spring in a bending direction.

36. Sheet conveying means according to claim 34, wherein the closely wound coil spring is capable of changing the initial tension by varying the twisting degree when the coil is closely wound and changing a load range in a bending direction when a bending amount at a center span of the spring is at least 0.5 mm and no more than 2.0 mm from at least 17 g and no more than 21 g to at least 7 g and no more than 10 g.

37. Sheet conveying means according to claim 34, wherein when a load of the closely wound coil spring is at least 8 g and no more than 10 g when a spring constant is 44 g/mm, an outer diameter of the coil spring is at least 8.95 mm and no more than 9.05 mm, a diameter of a wire forming the coil spring is at least 0.19 mm and no more than 0.21 mm, a length of the coil spring is at least 18.2 mm and no more than 18.6 mm, an effective number of turns of the coil spring are 92, and a span length of the coil spring is 16 mm, then a bending amount of a center span is 1 mm.

38. Sheet conveying means according to claim 34, wherein the closely wound coil spring has a spring constant of at least 10 g/mm and no more than 100 g/mm.

39. Sheet conveying means according to claim 34, wherein the closely wound coil spring has an outer diameter of at least 0.5 mm and no more than 2 mm.

40. Sheet conveying means according to claim 34, wherein a diameter of a wire forming the closely wound coil spring is equal to one-fifth of the outer diameter of the coil spring.

41. Sheet conveying means according to claim 34, wherein the closely wound coil spring has a span length of the coil spring of at least 5 mm and no more than 30 mm.

42. Sheet conveying means according to claim 34, wherein the closely wound coil spring has a span bending amount of at least 1 mm and no more than 2 mm.

43. An apparatus for effecting recording on a sheet, said apparatus comprising:

sheet conveying means for conveying the sheet, said conveying means including a first rotatable member for guiding the sheet, said first rotatable member being provided opposed to a second rotatable member for conveying the sheet, and a closely wound coil spring for supporting said first rotatable member and bending to press said first rotatable member to the second rotatable member when guiding the sheet, said closely wound coil spring having a first portion, one side end of which is movably supported, a second portion, another side end of which is movably supported, and an intermediate portion provided between said first and second portions, said first, second and intermediate portions being continuously formed; and a conveyance system for defining a conveyance route for conveying the sheet to said sheet conveying means, wherein the closely wound coil spring is capable of changing an initial tension by varying a twisting degree applied when a coil is closely wound.

44. An apparatus according to claim 43, wherein the closely wound coil spring is capable of changing the initial tension by varying the twisting degree applied when the coil is closely wound and changing the relation between a bending amount at a center span of the spring and a load of the spring in a bending direction.

45. An apparatus according to claim 43, wherein the closely wound coil spring is capable of changing the initial tension by varying the twisting degree when the coil is closely wound and changing a load range in a bending direction when a bending amount at a center span of the spring is at least 0.5 mm and no more than 2.0 mm from at least 17 g and no more than 21 g to at least 7 g and no more than 10 g.

46. An apparatus according to claim 43, wherein when a load of the closely wound coil spring is at least 8 g and no more than 10 g when a spring constant is 44 g/mm, an outer diameter of the coil spring is at least 8.95 mm and no more than 9.05 mm, a diameter of a wire forming the coil spring is at least 0.19 mm and no more than 0.21 mm, a length of the coil spring is at least 18.2 mm and no more than 18.6 mm, an effective number of turns of the coil spring are 92, and a span length of the coil spring is 16 mm, then a bending amount of a center span is 1 mm.

47. An apparatus according to claim 43, wherein the closely wound coil spring has a spring constant of at least 10 g/mm and no more than 100 g/mm.

48. An apparatus according to claim 43, wherein the closely wound coil spring has an outer diameter of at least 0.5 mm and no more than 2 mm.

49. An apparatus according to claim 43, wherein a diameter of a wire forming the closely wound coil spring is equal to one-fifth of the outer diameter of the coil spring.

50. An apparatus according to claim 43, wherein the closely wound coil spring has a span length of the coil spring of at least 5 mm and no more than 30 mm.

51. An apparatus according to claim 43, wherein the closely wound coil spring has a span bending amount of at least 1 mm and no more than 2 mm.

52. An apparatus according to claim 43, further comprising recording means for recording on the sheet, wherein said recording means comprises a recording head provided with an electro-thermal conversion member for generating heat energy in conformity with a recording signal, and which utilizes the heat energy to discharge ink.

53. A recording apparatus according to claim 43, further comprising recording means for recording on the sheet, wherein said recording means comprises an electro-thermal conversion member for generating heat energy which causes the film boiling in ink.

54. An ink jet recording apparatus comprising:

conveying means for conveying a recording medium, said conveying means comprising a first rotatable member for guiding the recording medium, said first rotatable member being provided opposed to a second rotatable member for conveying the recording medium, and a closely wound coil spring for supporting said first rotatable member and bending to press said first rotatable member to the second rotatable member when guiding the sheet, said closely wound coil spring having a first portion, one side end of which is movably supported, a second portion, another side end of which is movably supported, and an intermediate portion provided between said first and second portions, said first, second and intermediate portions being continuously formed; and a support member for supporting an ink jet recording head having a discharge port for discharging ink onto the recording medium, wherein the closely wound coil spring is capable of changing an initial tension by varying a twisting degree applied when a coil is closely wound.

55. An apparatus according to claim 54, wherein the closely wound coil spring is capable of changing the initial tension by varying the twisting degree applied when the coil is closely wound and changing the relation between a bending amount at a center span of the spring and a load of the spring in a bending direction.

56. An apparatus according to claim 54, wherein the closely wound coil spring is capable of changing the initial tension by varying the twisting degree when the coil is closely wound and changing a load range in a bending direction when a bending amount at a center span of the spring is at least 0.5 mm and no more than 2.0 mm from at least 17 g and no more than 21 g to at least 7 g and no more than 10 g.

57. An apparatus according to claim 54, wherein when a load of the closely wound coil spring is at least 8 g and no more than 10 g when a spring constant is 44 g/mm, an outer diameter of the coil spring is at least 8.95 mm and no more than 9.05 mm, a diameter of a wire forming the coil spring is at least 0.19 mm and no more than 0.21 mm, a length of the coil spring is at least 18.2 mm and no more than 18.6 mm, an effective number of turns of the coil spring are 92, and a span length of the coil spring is 16 mm, then a bending amount of a center span is 1 mm.

58. An apparatus according to claim 54, wherein the closely wound coil spring has a spring constant of at least 10 g/mm and no more than 100 g/mm.

59. An apparatus according to claim 54, wherein the closely wound coil spring has an outer diameter of at least 0.5 mm and no more than 2 mm.

60. An apparatus according to claim 54, wherein a diameter of a wire forming the closely wound coil spring is equal to one-fifth of the outer diameter of the coil spring.

61. An apparatus according to claim 54, wherein the closely wound coil spring has a span length of the coal spring of at least 5 mm and no more than 30 mm.

62. An apparatus according to claim 54, wherein the closely wound coil spring has a span bending amount of at least 1 mm and no more than 2 mm.

63. A sheet guiding device comprising:

a rotatable member provided contactably with a sheet to guide the sheet;

an elastic shaft member for supporting said rotatable member; and a support member for supporting both ends of said elastic shaft member, wherein said elastic shaft member is supported by said support member at a peripheral surface of said elastic shaft member and comprises a closely wound coil spring for bending when guiding the sheet to press said rotatable member to the sheet, wherein the closely wound coil spring is capable of changing an initial tension by varying a twisting degree applied when a coil is closely wound.

64. A sheet guiding device according to claim 63, wherein the closely wound coil spring is capable of changing the initial tension by varying the twisting degree applied when the coil is closely wound and changing the relation between a bending amount at a center span of the spring and a load of the spring in a bending direction.

65. A sheet guiding device according to claim 63, wherein the closely wound coil spring is capable of changing the initial tension by varying the twisting degree when the coil is closely wound and changing a load range in a bending direction when a bending amount at a center span of the spring is at least 0.5 mm and no more than 2.0 mm from at least 17 g and no more than 21 g to at least 7 g and no more than 10 g.

66. A sheet guiding device according to claim 63, wherein when a load of the closely wound coil spring is at least 8 g and no more than 10 g when a spring constant is 44 g/mm, an outer diameter of the coil spring is at least 8.95 mm and no more than 9.05 mm, a diameter of a wire forming the coil spring is at least 0.19 mm and no more than 0.21 mm, a length of the coil spring is at least 18.2 mm and no more than 18.6 mm, an effective number of turns of the coil spring are 92, and a span length of the coil spring is 16 mm, then a bending amount of a center span is 1 mm.

67. A sheet guiding device according to claim 63, wherein the closely wound coil spring has a spring constant of at least 10 g/mm and no more than 100 g/mm.

68. A sheet guiding device according to claim 63, wherein the closely wound coil spring has an outer diameter of at least 0.5 mm and no more than 2 mm.

69. A sheet guiding device according to claim 63, wherein a diameter of a wire forming the closely wound coil spring is equal to one-fifth of the outer diameter of the coil spring.

70. A sheet guiding device according to claim 63, wherein the closely wound coil spring has a span length of the coil spring of at least 5 mm and no more than 30 mm.

71. A sheet guiding device according to claim 63, wherein the closely wound coil spring has a span bending amount of at least 1 mm and no more than 2 mm.

72. A sheet guiding device according to claim 63, further comprising recording means for recording on the sheet and said recording means comprises an ink jet recording head having an ink discharge port for discharging ink onto the sheet.

73. A sheet guiding device according to claim 63, further comprising recording means for recording on the sheet and said recording means comprises an ink jet recording head having an electrothermal converting element and discharges ink through an ink discharge port by utilizing thermal energy generated by said electrothermal converting element.

74. A recording apparatus for recording on a sheet, said apparatus comprising:

a sheet guiding device having a rotatable member provided contactably with the sheet to guide the sheet, an elastic shaft member for supporting said rotatable member, and a support member for supporting both ends of said elastic shaft member, wherein said elastic shaft member is supported by said support member at a peripheral surface of said elastic shaft member and comprises a closely wound coil spring for bending when guiding the sheet to press said rotatable member to the sheet; and a conveyance device for defining a conveyance route for conveying the sheet to said sheet guiding device, wherein the closely wound coil spring is capable of changing an initial tension by varying a twisting degree applied when a coil is closely wound.

75. An apparatus according to claim 74, wherein the closely wound coil spring is capable of changing the initial tension by varying the twisting degree applied when the coil is closely wound and changing the relation between a bending amount at a center span of the spring and a load of the spring in a bending direction.

76. An apparatus according to claim 74, wherein the closely wound coil spring is capable of changing the initial tension by varying the twisting degree when the coil is closely wound and changing a load range in a bending direction when a bending amount at a center span of the spring is at least 0.5 mm and no more than 2.0 mm from at least 17 g and no more than 21 g to at least 7 g and no more than 10 g.

77. An apparatus according to claim 74, wherein when a load of the closely wound coal spring is at least 8 g and no more than 10 g when a spring constant is 44 g/mm, an outer diameter of the coil spring is at least 8.95 mm and no more than 9.05 mm, a diameter of a wire forming the coil spring is at least 0.19 mm and no more than 0.21 mm, a length of the coil spring is at least 18.2 mm and no more than 18.6 mm, an effective number of turns of the coil spring are 92, and a span length of the coil spring is 16 mm, then a bending amount of a center span is 1 mm.

78. An apparatus according to claim 74, wherein the closely wound coil spring has a spring constant of at least 10 g/mm and no more than 100 g/mm.

79. An apparatus according to claim 74, wherein the closely wound coil spring has an outer diameter of at least 0.5 mm and no more than 2 mm.

80. An apparatus according to claim 74, wherein a diameter of a wire forming the closely wound coil spring is equal to one-fifth of the outer diameter of the coil spring.

81. An apparatus according to claim 74, wherein the closely wound coil spring has a span length of the coil spring of at least 5 mm and no more than 30 mm.

82. An apparatus according to claim 74, wherein the closely wound coal spring has a span bending amount of at least 1 mm and no more than 2 mm.

83. An apparatus according to claim 74, further comprising recording means for recording on the sheet, wherein said recording means comprises a recording head provided with an electro-thermal conversion member for generating heat energy in conformity with a recording signal, and which utilizes the heat energy to discharge ink.

84. A recording apparatus according to claim 74, further comprising recording means for recording on the sheet, wherein said recording means comprises an electro-thermal conversion member for generating heat energy which causes the film boiling in ink.

85. An ink jet recording apparatus comprising:

a sheet guiding device having a rotatable member provided contactably with a sheet to guide the sheet, an elastic shaft member for supporting said rotatable member, and a support member for supporting both ends of said elastic shaft member, wherein said elastic shaft member is supported by said support member at a peripheral surface of said elastic shaft member and comprises a closely wound coil spring for bending when guiding the sheet to press said rotatable member to the sheet; and a mounting member for mounting an ink jet recording head having a discharge port for discharging ink onto the sheet, wherein the closely wound coil spring is capable of changing an initial tension by varying a twisting degree applied when a coil is closely wound.

86. An apparatus according to claim 85, wherein the closely wound coil spring is capable of changing the initial tension by varying the twisting degree applied when the coil is closely wound and changing the relation between a bending amount at a center span of the spring and a load of the spring in a bending direction.

87. An apparatus according to claim 85, wherein the closely wound coil spring is capable of changing the initial tension by varying the twisting degree when the coil is closely wound and changing a load range in a bending direction when a bending amount at a center span of the spring is at least 0.5 mm and no more than 2.0 mm from at least 17 g and no more than 21 g to at least 7 g and no more than 10 g.

88. An apparatus according to claim 85, wherein when a load of the closely wound coil spring is at least 8 g and no more than 10 g when a spring constant is 44 g/mm, an outer diameter of the coil spring is at least 8.95 mm and no more than 9.05 mm, a diameter of a wire forming the coil spring is at least 0.19 mm and no more than 0.21 mm, a length of the coil spring is at least 18.2 mm and no more than 18.6 mm, an effective number of turns of the coil spring are 92, and a span length of the coil spring is 16 mm, then a bending amount of a center span is 1 mm.

89. An apparatus according to claim 85, wherein the closely wound coil spring has a spring constant of at least 10 g/mm and no more than 100 g/mm.

90. An apparatus according to claim 85, wherein the closely wound coil spring has an outer diameter of at least 0.5 mm and no more than 2 mm.

91. An apparatus according to claim 85, wherein a diameter of a wire forming the closely wound coil spring is equal to one-fifth of the outer diameter of the coil spring.

92. An apparatus according to claim 85, wherein the closely wound coil spring has a span length of the coil spying of at least 5 mm and no more than 30 mm.

93. An apparatus according to claim 85, wherein the closely wound coil spring has a span bending amount of at least 1 mm and no more than 2 mm.

94. An apparatus according to claim 85, wherein said ink jet recording head comprises an electrothermal converting element and discharges ink through an ink discharge port by utilizing thermal energy generated by said electrothermal converting element.

* * * * *

UNITED STATES PATENT AND TRADEMARK OFFICE

CERTIFICATE OF CORRECTION

PATENT NO. : 5,606,357

DATED : February 25, 1997

INVENTOR(S) : TOSHIHIKO BEKKI

It is certified that error appears in the above-indentified patent and that said Letters Patent is hereby corrected as shown below:

COLUMN 12

Line 25, "coal" should read --coil--.

COLUMN 13

Line 1, "92," should read --92,--.
Line 61, "coal" should read --coil--.

COLUMN 14

Line 15, "coal" should read --coil--.

COLUMN 15

Line 12, "spying" should read --spring--.

Signed and Sealed this

Twelfth Day of August, 1997

Bruce Lehman

*Attest:*

BRUCE LEHMAN

*Attesting Officer*

*Commissioner of Patents and Trademarks*